US005088845A

United States Patent [19]

Kurachi

[11] Patent Number: 5,088,845

[45] Date of Patent: Feb. 18, 1992

[54] RIBBON CASSETTE FOR MECHANICALLY UNLOCKING A PRINTING MECHANISM UPON INSERTION OF THE RIBBON CASSETTE INTO A PRINTING DEVICE

[75] Inventor: Hisao Kurachi, Okazaki, Japan

[73] Assignee: Brother Kogyo Kabushiki Kaisha, Japan

[21] Appl. No.: 485,518

[22] Filed: Feb. 27, 1990

[30] Foreign Application Priority Data

Oct. 6, 1989 [JP] Japan ..... 1-262649

[51] Int. Cl.[5] ..... B41J 35/28

[52] U.S. Cl. ..... 400/208; 400/208.1; 400/664; 400/157.2

[58] Field of Search ..... 400/207, 208, 208.1, 400/194, 195, 196, 196.1, 231, 664, 157.2; 101/93.02, 93.09, 93.18, 93.35

[56] References Cited

U.S. PATENT DOCUMENTS

| | | | |
|---|---|---|---|
| 4,623,272 | 11/1986 | Kondo | 400/208 |
| 4,624,592 | 11/1986 | Purcell | 400/208 |
| 4,642,658 | 2/1987 | Arakawa | 400/208 |
| 4,712,933 | 12/1987 | Natsume | 400/208 |
| 4,728,208 | 3/1988 | Iwase et al. | 400/208 |
| 4,729,676 | 3/1988 | Smith et al. | 400/208 |
| 4,754,920 | 6/1988 | Kitayami et al. | 400/207 |
| 4,789,256 | 12/1988 | Ukmar et al. | 400/208 |
| 4,810,117 | 3/1989 | Hattori | 400/208 |
| 4,900,171 | 2/1990 | Mueller et al. | 400/208 |
| 4,904,097 | 2/1990 | Falconieri et al. | 400/208 |

*Primary Examiner*—Edgar S. Burr
*Assistant Examiner*—Joseph R. Keating
*Attorney, Agent, or Firm*—Oliff & Berridge

[57] ABSTRACT

A ribbon cassette is selectively mounted in a printing device having an operating mechanism actuable between locked and released states. The ribbon cassette has a casing for accommodating therein a print ribbon that cooperates with the operating mechanism for printing characters. The cassette also includes an actuating mechanism for mechanically unlocking the operating mechanism to the released state when the casing is inserted into the printing device. In a preferred embodiment, the actuating mechanism is a projection on a wall of the casing that abuts a locking linkage within the printing device and moves the locking linkage to unlock the operating mechanism.

15 Claims, 7 Drawing Sheets

RIBBON CASSETTE FOR MECHANICALLY UNLOCKING A PRINTING MECHANISM UPON INSERTION OF THE RIBBON CASSETTE INTO A PRINTING DEVICE

BACKGROUND OF THE INVENTION

1. Field of the Invention

The present invention relates to a ribbon cassette attached to a printing device, and more particularly to a ribbon cassette for preventing an operating mechanism of the printing device from operating in a printing operation when the cassette is not attached to the printing device.

2. Discussion of Related Art

Conventionally, an electric detector is used as a sensor for detecting whether a ribbon cassette is installed or not, and the detector is operated by an operating projection formed on the ribbon cassette. When the detector is not actuated by the operating projection of the ribbon cassette, that is, when it is detected that the ribbon cassette is not attached, a control signal is applied for inhibiting a printing operation.

However, a carriage with the ribbon cassette attached thereon reciprocates along a printing line of a printing sheet and a control device for controlling the printing apparatus is placed on a circuit board fixed on a frame. Therefore, an electric wire has to be connected with the detector on the movable carriage and the circuit board so that wiring becomes complicated. The control device also has to provide an input port to input a detecting signal outputted from the detector so that the number of functions of the control device is limited. Further, the control device has to be always detecting the condition of the input port whether the detecting signal is input or searching the input port in interruption handling, so that a control program becomes more complicated and a program memory has to be increased. Accordingly, apart from adapting a construction of the ribbon cassette to a printing device employing a detector, the detector has other disadvantageous influences for a printing device by adding a very difficult design condition and increasing a product cost.

SUMMARY OF THE INVENTION

A purpose of the present invention is to resolve the above described problems and to provide a ribbon cassette for mechanically prohibiting a printing operation of the printing mechanism or permit such a printing operation with a simple structure without adding any complex members to the printing apparatus body.

To accomplish the above purpose, the ribbon cassette of the present invention is a type of a ribbon cassette attached to the printing apparatus having a locking mechanism for locking a printing mechanism in an inoperable condition. The ribbon cassette has a mechanical portion for moving a locking member of the locking mechanism from a locking position where the printing mechanism is locked by the locking member to a release position where the printing mechanism is able to operate, when the ribbon cassette is installed in the printing apparatus.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

In a typewriter, a platen 2 (FIG. 1) is rotatably supported on a frame (not shown), and a guide bar 3 and a guide rail 4 are extending parallel to the platen 2. A carriage 5 is supported on the guide bar 3 and the guide rail 4 and moves along a printing line of the platen 2. The carriage 5 is driven by a stepping motor as a carriage driving motor.

Figure 3:
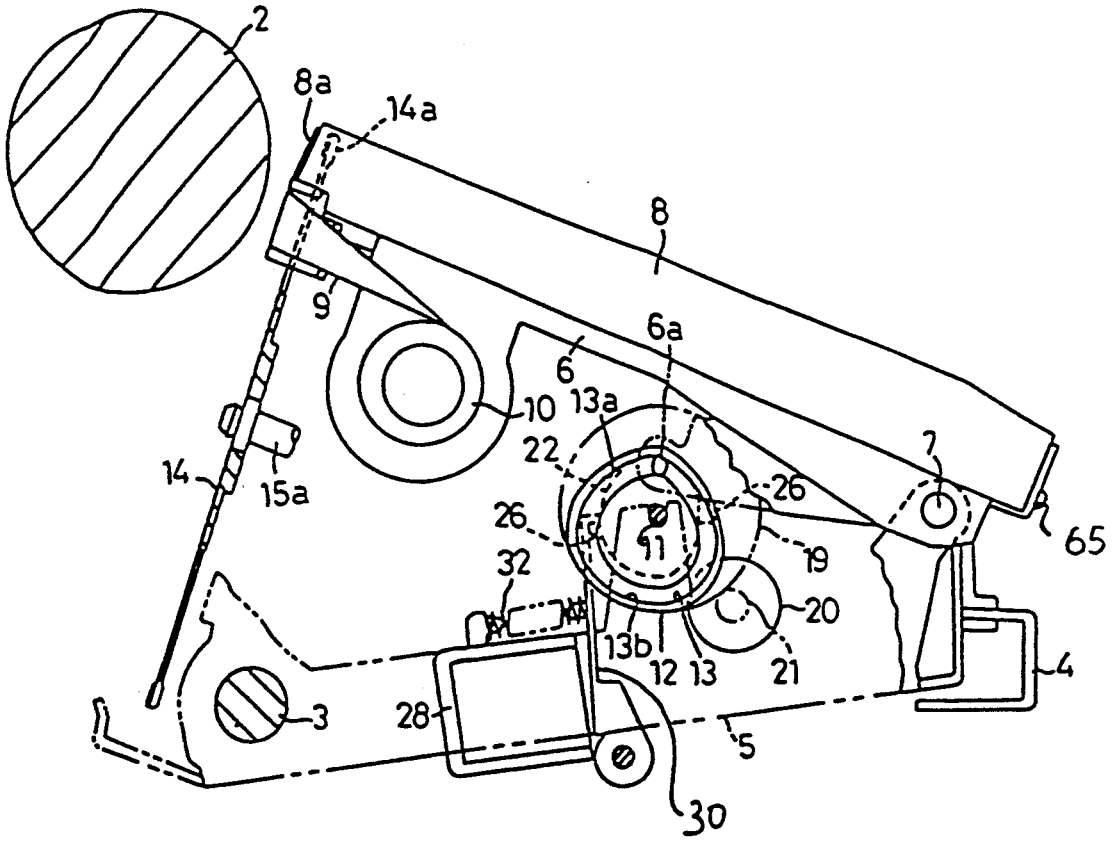
FIGS. 3 and 4 are side sectional views showing operation of the printing mechanism respectively.
Figure 6:
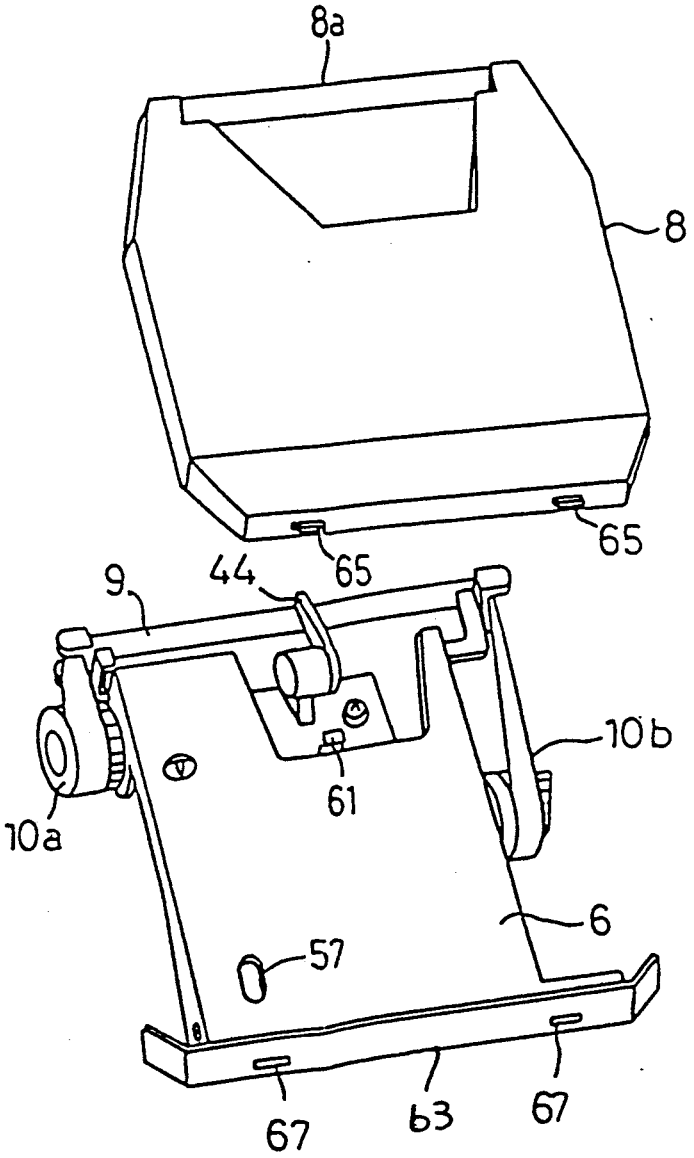
FIG. 6 is a perspective view showing the ribbon cassette and a ribbon holder.

On an upper portion of the carriage 5, as shown in FIG. 3, a ribbon holder 6 is pivotally supported on a shaft 7. The ribbon holder 6 has a plate-shape as shown in FIG. 6. A ribbon cassette 8 containing a printing ribbon 8*a* is attached on the ribbon holder 6. A part of the printing ribbon 8*a* is exposed from the cassette 8 as shown in FIG. 6. At both sides of the ribbon holder 6, a supply spool 10*a* having a wound-up unused correction ribbon 9 and a winding spool 10*b* for winding used correction ribbon 9 are rotatably supported, respectively. Under the exposed portion of the printing ribbon 8*a*, a feeding portion of the correction ribbon 9 between both spools 10*a* and 10*b* is positioned.

As shown in FIG. 3, a ribbon lifting cam 12 is rotatably supported on a shaft 11, fixed on the carriage 5. On one side surface of the ribbon lifting cam 12 is provided a grooved cam 13 having a smaller diameter portion 13*a* and a larger diameter portion 13*b*. A slave pin 6*a* is provided on the ribbon holder 6 for engaging the grooved cam 13. When the pin 6*a* engages with the smaller diameter portion 13*a*, the ribbon holder 6 is placed at the first lifting position written in a solid line in FIG. 1. When the slave pin 6*a* engages with the larger diameter portion 13*b*, the ribbon holder 6 is placed at the second lifting position written in a dot and dashed line in FIG. 1.

Figure 1:
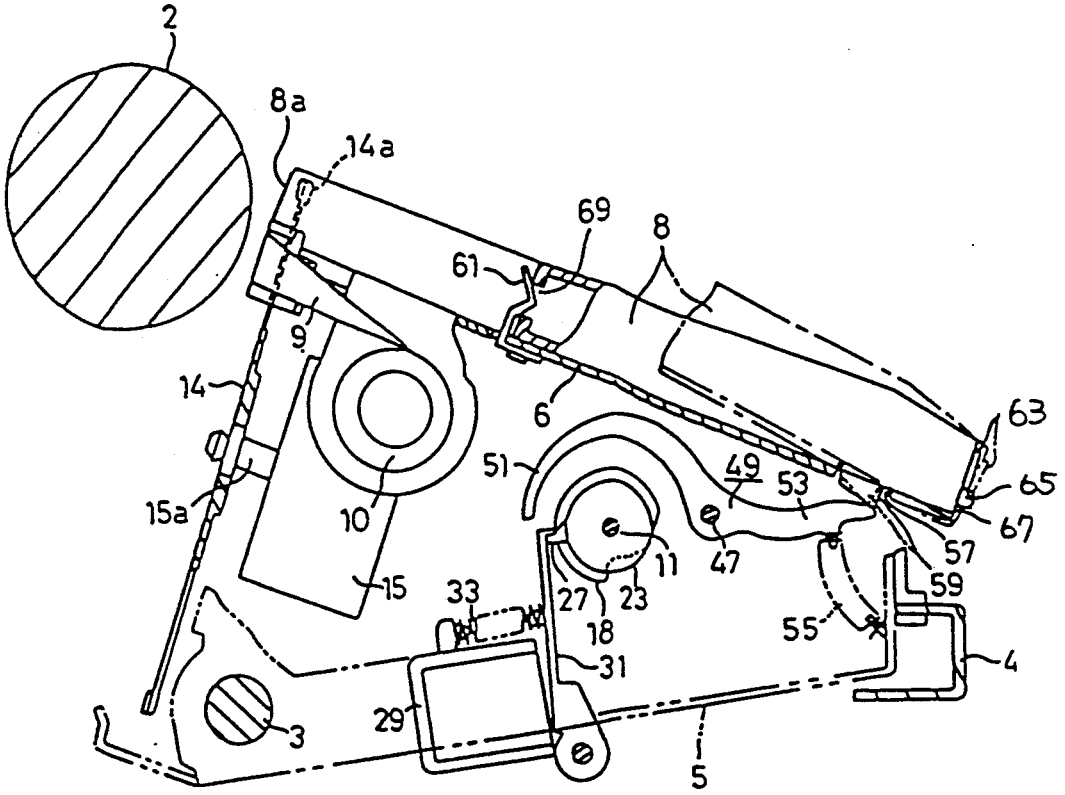
FIG. 1 is a side sectional view of a printing mechanism on which a ribbon cassette of the present invention is attached.

A daisy shaped printing head 14 (FIG. 1) having a number of printing type elements on its peripheral surface is rotatably provided on the carriage 5. A central portion of the printing head 14 is connected to a motor shaft 15*a* of the type selecting motor 15 as shown in FIG. 1. One printing type element is selectively turned to a printing position in accordance with the type selecting motor rotating, and then, a letter is printed on a printing sheet on the platen 2 through the printing ribbon 8*a* or a wrong letter is eliminated from the printing sheet through the correction tape 9 by striking the printing hammer 44 (described below with reference to FIG. 4).

Figure 4:
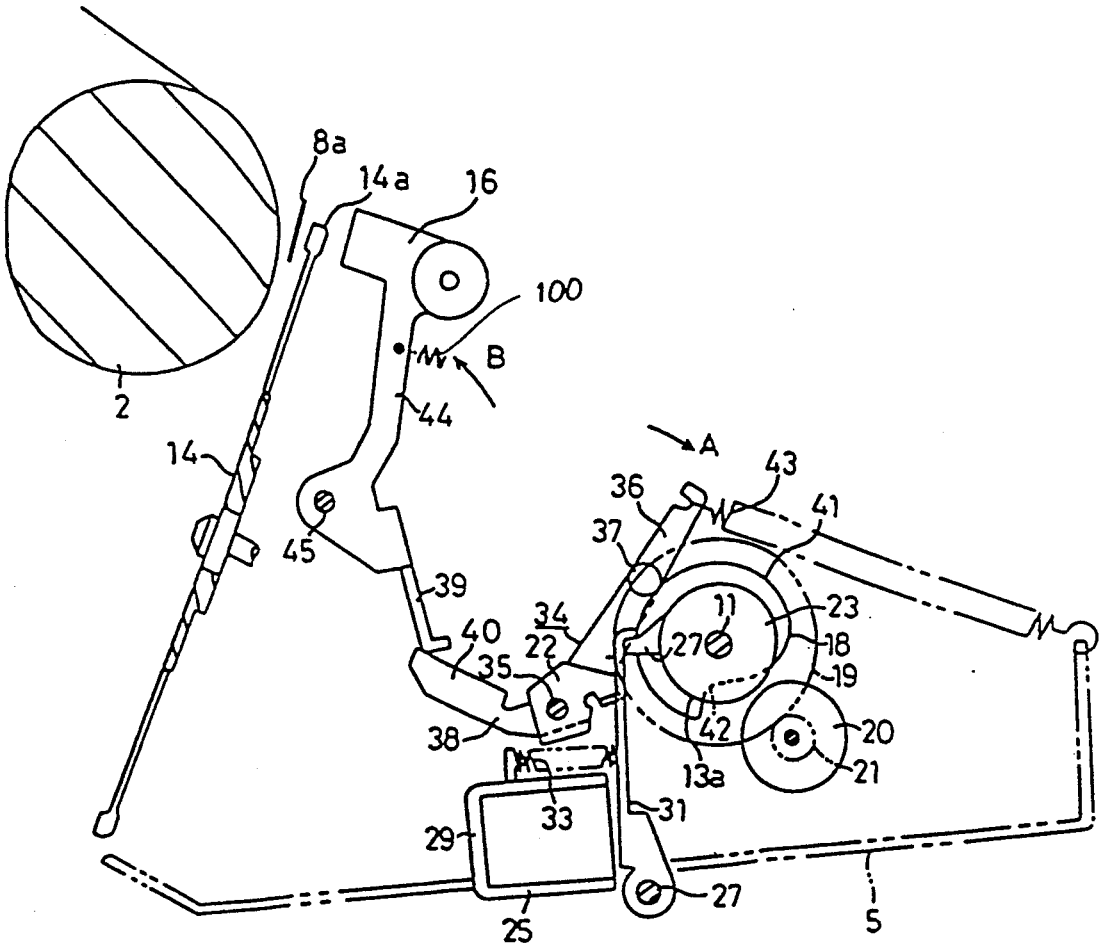
Figure 5:
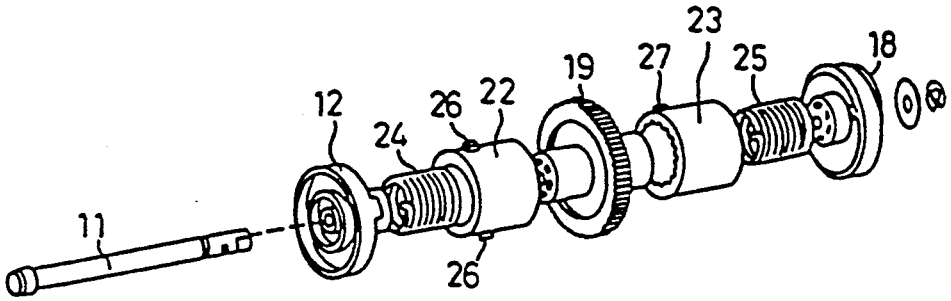
FIG. 5 is an exploded sectional view of a clutch mechanism.

As shown in FIG. 5, a hammer driving cam 18 and a driven cam 19 are rotatably supported on the shaft 11. A driven gear 19 is rotated by the hammer driving motor 20 (FIG. 4; hereinafter "motor") mounted on the carriage 5 via the driving gear 21 supported on the rotating shaft of the motor 20.

On the shaft 11, a clutch mechanism is provided. The clutch mechanism transmits or interrupts a rotation force of the driven gear 19 rotated by the motor 20 to the ribbon lift cam 12 and a hammer driving cam 18. The clutch mechanism is constituted of rotational engaging members 22, 23 (FIG. 5) located between the driven gear 19 and the two cams 12, 18 and well-known clutch springs 24, 25 located inside of the engaging members 22, 23.

A pair of locking protrusions 26 are provided at equal intervals on an outer peripheral surface of the engaging member 22, which is abutting the ribbon lifting cam 12. On an outer peripheral surface of the rotation member 23, which is abutting the hammer driving cam 18, a locking protrusion 27 is provided. When the engaging members 22 and 23 are inhibited to rotate in such a clutch mechanism, a driving transmitting force from the driven gear 19 to the cams 12 and 18 is interrupted by the clutch springs 24 and 25. When the engaging members 22 and 23 are released, the rotation of the driven gear 19 is transmitted to cams 12 and 18. Then, the cams 12 and 18 turn clockwise in FIG. 3.

Figure 2:
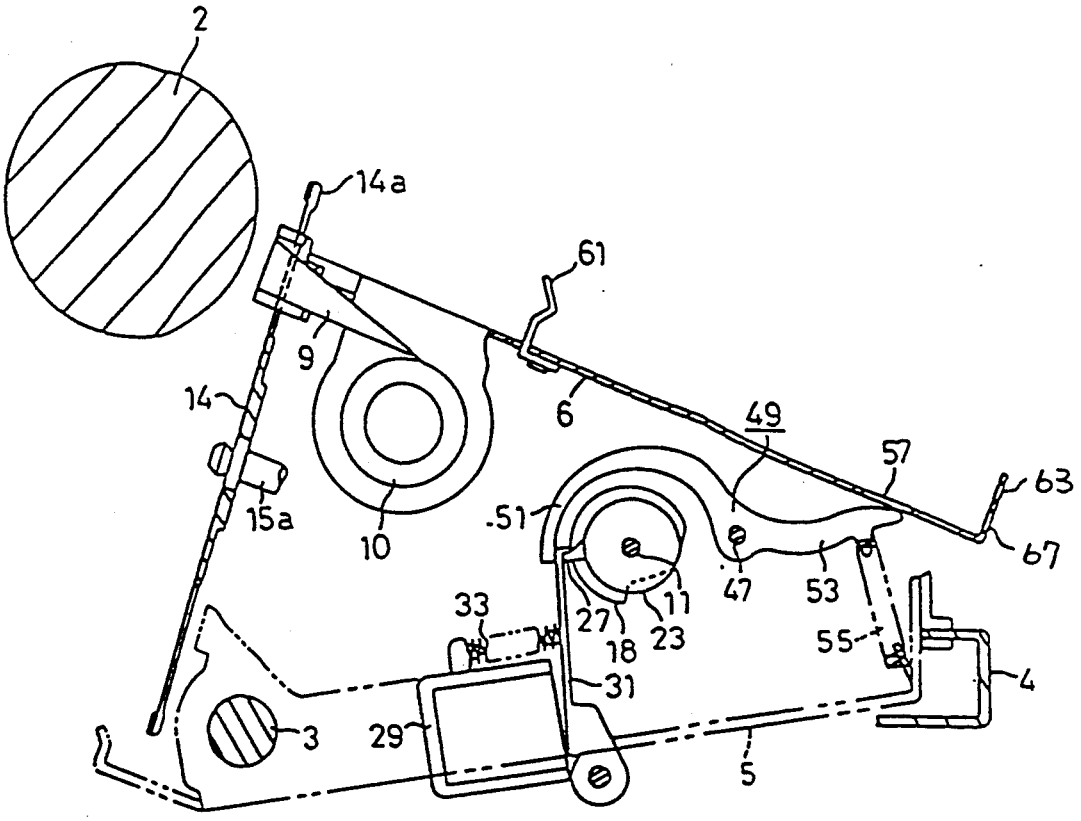
FIG. 2 is a side sectional view of the printing mechanism from which a ribbon cassette of the present invention is detached.

As shown in FIGS. 1 through 4, trigger solenoids 28 and 29, which are corresponding to the cams 12 and 18, respectively, are provided parallel to each other on the carriage 5, the solenoid 28 being illustrated in FIG. 3 and the solenoid 29 being illustrated in FIGS. 1, 2 and 4. Two armatures 30 and 31 are rotatably supported near each solenoid 28 and 29, and are urged in a clockwise direction in FIGS. 1 through 4 by tension springs 32 and 33 provided on each solenoid 28 and 29. When the armatures 30 and 31 are retracted against the biasing force of the springs 32 and 33 by energizing of the solenoids 28 and 29, a tip bent portion of the armatures 30 and 31 is drawn in an exterior direction away from the protrusions 26 and 27. When energizing of the solenoids 28 and 29 is stopped, the tip bent portions of the armatures 30 and 31 are moved in an inside direction toward the protrusions 26 and 27 by the biasing force of the springs 32 and 33, and engaged with the protrusions 26 and 27.

In the clutch mechanism, when the armatures 30 and 31 engage with the protrusions 26 and 27, rotation of the engaging members 22 and 23 is locked, so that the driving force transmitted from the driven gear 19 to the cams 12 and 18 can be interrupted. When the armatures 30 and 31 are released from the protrusions 26 and 27, the engaging members 22 and 23 are also released from locking, so that the driving force can be transmitted from the driven gear to the cams 12 and 18.

On the other hand, as shown in FIG. 4, a printing hammer 44 is positioned abutting to the printing head 14 and is pivotably supported on a shaft 45. Usually the printing hammer 44 is located at an inoperative position separated from the platen 2, and in a printing operation, the printing hammer 44 is turned to a printing position for striking a printing type element 14*a* toward the platen 2. The hammer 44 is always urged toward the inoperative position, i.e. a clockwise direction, by a spring 100 (shown in FIG. 4).

A crank 34 having two operating arms is rotatably supported on the shaft 35 at a central portion of the crank 34. As shown in FIG. 4, the first arm 36 has a cam follower member 37 for engaging with the cam 18, and the second arm 38 has an engaging portion 40 for engaging with a connecting portion 39 of the printing hammer 44.

When the cam follower member 37 is engaged with the cam 18 at a portion having the constant diameter, the crank 34 is maintained at the position as shown in FIG. 4. The printing hammer 44 is maintained at the inoperative position by engagement of the connecting portion 39 and the engaging portion 40 of the crank 34 positioned at the position as shown in FIG. 4. When the cam follower member 37 confronts with a recessed portion 42 of the cam 18 by the clockwise rotation of the cam 18, the crank 34 is allowed to turn in a direction as shown in an arrow A in FIG. 4. The connecting portion 39 of the printing hammer 44 is kicked upwardly by the engaging portion 40 of the crank 34, then the printing hammer 44 turns in a direction as shown in an arrow B in FIG. 4.

As shown in FIGS. 1 and 2, a locking lever 49 is rotatably supported on a shaft 47 fixed on the carriage 5 over the engaging member 23 adjacent to the cam 18. The locking lever 49 has a semi-circular shaped arm portion 51 for covering an upper portion of the engaging member 23 and an operating portion 53 extending along an opposite side of the arm portion 51. Usually, the locking lever 49 is energized in a counterclockwise direction by a tension spring 55 fixed between the operating portion 53 and an edge of the carriage 5 adjacent the guide rail 4 (i.e., to the right in FIGS. 1 and 2). The counterclockwise bracing force of the locking lever 49 by the tension spring 55 is stronger than the clockwise retracting force applied to the locking lever 49 by the armature when the trigger solenoid 29 is energized.

The ribbon holder 6 has an opening portion 57 (FIGS. 1, 2 and 6) at a portion confronting with the operating portion 53. The ribbon cassette 8 has an operating projection 59 attached at the bottom surface of the cassette 8. When the ribbon cassette 8 is attached on the ribbon holder 6, the operating projection 59 is inserted into the opening portion 57 of the ribbon holder 6 and engages with the operating portion 53.

When the ribbon cassette 8 is not attached on the ribbon holder 6 as shown in FIG. 2, the locking lever 49 is urged in the counterclockwise direction by the spring 55 and a tip portion of the arm portion 51 is maintained in locking position contacting with armature 31. In the condition as shown in FIG. 2, even if the armature 31 is retracted by the energized solenoid 29, the armature 31 is prevented from moving toward the solenoid 29 by the locking lever 49. Accordingly, the clutch mechanism including the engaging member 23 is not connected, so that the printing hammer cannot be operated when the ribbon cassette 8 is not loaded into the ribbon holder 6.

However, when the ribbon cassette 8 is attached on the ribbon holder 6, the locking lever 49 could be turned clockwise by the operating projection 59 of the ribbon cassette 8 against the bracing force of the tension spring 55, so that the locking lever 49 moves to a release position. Then, the armature 31 is released from the locking state and the armature 31 can rotate counterclockwise when the solenoid 29 is energized. Accordingly, when the ribbon cassette 8 is attached on the ribbon holder 6, the printing hammer 44 is in an operable condition.

As shown in FIG. 2, a bent flat spring 61 is provided at a middle portion of the ribbon holder 6. The flat spring 51 has a sufficient spring force to maintain the ribbon cassette on the ribbon holder 6. The ribbon holder 6 has a maintaining portion 63, which is perpendicularly bent to the bottom plate of the cassette holder 6, at a tail end of the ribbon holder 6. Locking openings 67 are provided at both sides of the maintaining portion 63, respectively. A pair of protrusions 65 are formed on a tail end surface of the ribbon cassette 8. When the ribbon cassette 8 is attached the ribbon holder 6, the protrusions 65 are inserted into the locking openings 67 and urged therein by the bent flat spring 61.

In case that the ribbon cassette 8 of the present invention is attached on the ribbon holder 6, at first the protrusions 65 of the ribbon cassette 8 are inserted into the locking openings 67 of the maintaining portion 63, then the ribbon cassette is pressed toward the ribbon holder 6 so that the flat spring 61 engages with a notch 69 of the ribbon cassette 8. Thereby, the ribbon cassette 8 is maintained on the ribbon holder 6. Simultaneously, the operating projection 59 of the ribbon cassette 8 is pressing down on the operating portion 53 of the locking lever 49 against the spring force of the tension spring 55, so that the locking lever 49 can be moved from the locking position to the released position.

In other words, although the ribbon cassette 8 is always pressurized upwardly by the tension spring 55 acting on the locking lever 49, the ribbon cassette 8 is not detached from the ribbon holder 6 since the operating portion 53 of the locking lever 49 and the operating projection 59 of the ribbon cassette are located at a position near the maintaining portion 63 of the ribbon holder 6, and the bent flat spring 61 urges the protrusions 65 of the ribbon cassette 8 into the locking openings 67 of the maintaining portion 63.

Next, the second embodiment of the present invention will be described with reference to FIG. 7. Therein, the members described in the first embodiment are identified with the same reference number and the description of the same members is omitted.

Figure 7:
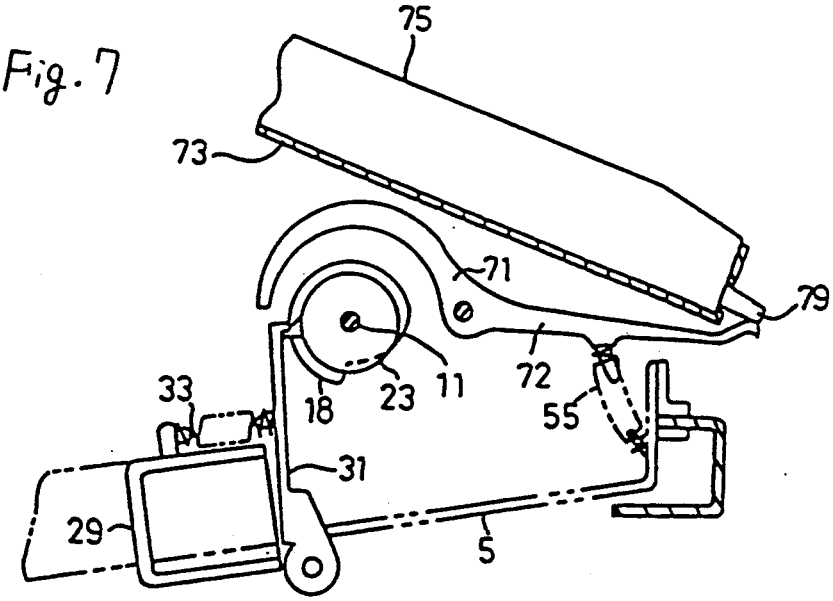
FIG. 7 is a side sectional view showing the second embodiment of the present invention.

In the second embodiment, an operating portion 72 of the rotatably supported locking lever 71 is further extended to the right in FIG. 7. A projection of a ribbon cassette 75 is further extending rightward and forms an operating projection 79. When the ribbon cassette 75 is attached on the ribbon holder 73, the operating portion 72 of the locking lever 71 and the projection 79 of the ribbon cassette 75 are engaged with each other, and then the locking lever 71 turns clockwise. In accordance with the above engagement, the locking lever 71 releases the armature 31.

In the second embodiment, even if the pressurized force of the tension spring 55 is applied upwardly to the operating projection 79, the ribbon cassette 75 is not detached from the ribbon holder 73, since the operating protrusion 79 is extended through the locking openings 67 of the maintaining portion 63.

Figure 8:
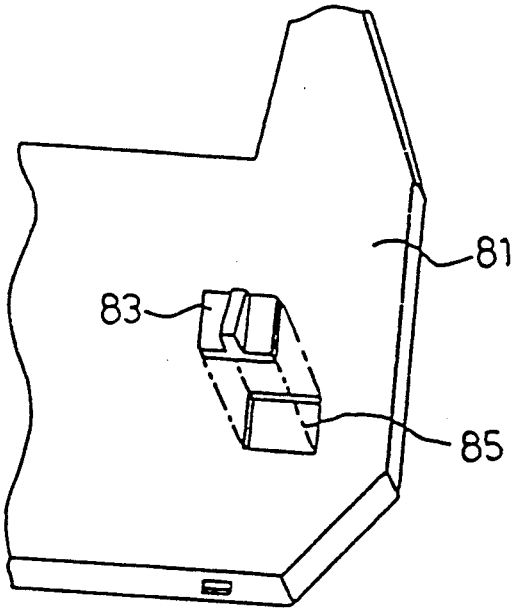
FIG. 8 is a side sectional view showing the third embodiment of the present invention.

In the first embodiment, the operating projection 59 is integrally formed with the cassette 8, however, an operating protrusion 83 may be detachable as shown in FIG. 8. A bottom surface of the ribbon cassette 81 has an installed portion 85 for installing the detachable operating projection 83. A dual sided adhesive tape is adhered on the bottom surface of the operating projection 83, which contacts with the installed portion 85. By peeling off a released paper of the tape, the operation protrusion 83 can be adhered on the installed portion 85. As described above, the operation protrusion 83 is separable and attachable. If the operating portion 83 is separated from the ribbon cassette 81 in a transit or packing condition, a volume of the ribbon cassette package can be reduced, and a transit fee and a packaging fee can be also reduced. Further, a stored space for the cassettes can be reduced.

What is claimed is:

1. A ribbon cassette selectively mounted in a printing device having: an operating mechanism cooperating with the ribbon cassette for printing characters; locking means movable between retracted and projected positions for selectively unlocking and locking the operating mechanism in operative and inoperative states, respectively; and a mechanical linkage movable between a released position for unlocking the locking means for movement between the retracted and projected positions and an engaged position for locking the locking means in the projected position to lock the operating mechanism in the inoperative state; the ribbon cassette comprising:

a casing for housing a ribbon supply and a ribbon take-up;

a ribbon in the housing exposed to the operating mechanism between the ribbon supply and ribbon take-up; and actuating means on the casing for mechanically moving the mechanical linkage to the released position upon insertion of the casing into the printing device.

2. The ribbon cassette of claim 1 wherein the actuating means includes an abutment surface on a wall of the casing.

3. The ribbon cassette of claim 2 wherein the abutment surface contacts the mechanical linkage in the printing device upon insertion of the casing into the printing device and moves the mechanical linkage to unlock the operating mechanism.

4. The ribbon cassette of claim 3, wherein the casing has top and bottom walls, and the abutment surface is located on the bottom wall of the casing.

5. The ribbon cassette of claim 4, wherein the abutment surface is a projection extending from the bottom wall of the casing.

6. The ribbon cassette of claim 5, wherein the projection is detachable from the casing.

7. The ribbon cassette of claim 3, wherein the casing has top and bottom walls and front and rear walls extending between the top and bottom walls, and the abutment surface is located on the rear wall of the casing.

8. The ribbon cassette of claim 7, wherein the abutment surface is a projection extending from the rear wall of the casing.

9. A printing mechanism on which a ribbon cassette is selectively mounted, the printing mechanism including an operating mechanism cooperating with the ribbon cassette for printing characters, locking means movable between retracted and projected positions for selectively unlocking and locking the operating mechanism in operative and inoperative positions, and a linkage for locking the locking means in the projected position to lock the operating mechanism in the inoperative position, the ribbon cassette comprising:

actuating means on the ribbon cassette for mechanically actuating the linkage to unlock the locking means to release the operating mechanism from the inoperative position upon insertion of the casing into the printing device.

10. The printing mechanism of claim 9 wherein the actuating means includes an abutment surface on the cassette abutting against the linkage to move the linkage into a position that releases the locking means.

11. The printing mechanism of claim 10 wherein the abutment surface is a projection.

12. The printing mechanism of claim 11, wherein the projection is detachable from the casing.

13. A ribbon cassette selectively mounted in a printing device having: an operating mechanism cooperating with the ribbon cassette for printing characters; locking means movable between retracted and projected positions for selectively unlocking and locking the operating mechanism in operative and inoperative states, respectively; and a mechanical linkage movable between a released position for unlocking the locking means for movement between the retracted and projected positions and an engaged position for locking the locking means in the projected position to lock the operating mechanism in the inoperative state; the ribbon cassette comprising:

a casing for housing a ribbon supply and a ribbon take-up;

a ribbon in the housing exposed to the operating mechanism between the ribbon supply and ribbon take-up; and a projection on the casing for moving the mechanical linkage from the engaged position to the released position upon insertion of the casing into the printing device.

14. A ribbon cassette according to claim 13, wherein said casing has a top wall and a bottom wall; said projection extends outwardly from said bottom wall, and said bottom wall and projection are formed as an integral unit.

15. A ribbon cassette according to claim 14 further comprising engaging means for positioning the ribbon cassette in an installed position on the carriage.

* * * * *